United States Patent [19]

Pollard et al.

[11] 4,353,309

[45] Oct. 12, 1982

[54] IMPROVEMENTS RELATING TO MOTORIZED RAILWAY VEHICLE TRUCK

[75] Inventors: Maurice G. Pollard, Mickleover; Robert Illingworth, Allestree, both of England

[73] Assignee: British Railways Board, London, England

[21] Appl. No.: 176,361

[22] Filed: Aug. 8, 1980

[30] Foreign Application Priority Data

Sep. 6, 1979 [GB] United Kingdom ..... 7930895

[51] Int. Cl.[3] ..... B61C 9/50

[52] U.S. Cl. ..... 105/136; 105/182 R

[58] Field of Search ..... 105/133, 135–137, 105/165–168, 182 R

[56] References Cited

U.S. PATENT DOCUMENTS

| | | | |
|---|---|---|---|
| 507,208 | 10/1893 | Brill | 105/135 |
| 644,199 | 2/1900 | Eyre | 105/135 |
| 1,822,895 | 9/1937 | Kiesel, Jr. | 105/135 X |
| 2,245,333 | 6/1941 | Frei | 105/168 |
| 3,516,365 | 6/1970 | Lich | 105/133 |
| 3,523,505 | 8/1970 | Lich | 105/133 X |
| 3,528,374 | 9/1970 | Wickens | 105/165 X |
| 4,167,906 | 9/1979 | Steinmann et al. | 105/136 X |

FOREIGN PATENT DOCUMENTS

| | | | |
|---|---|---|---|
| 61942 | 11/1948 | Netherlands | 105/167 |
| 587028 | 1/1978 | U.S.S.R. | 105/135 |

*Primary Examiner*—Randolph Reese

*Attorney, Agent, or Firm*—Pollock, Vande Sande & Priddy

[57] ABSTRACT

A motorized vehicle truck having a pair of wheel sets each with a live axle and a motor mounted on each axle with its axis parallel to the associated axle. Each motor is secured to prevent its rotation about the respective axle, but since this permits substantially unrestrained horizontal movement of the motors relative to the truck, braces are employed in the form of at least one link which is connected between the respective motor casings and pivotally, resiliently mounted for rotation about a vertical axis positioned between the motor casings. In this way, a stiffness is provided through the motor casing to restrain parallel shear movement of one wheel set horizontally relative to the other.

4 Claims, 6 Drawing Figures

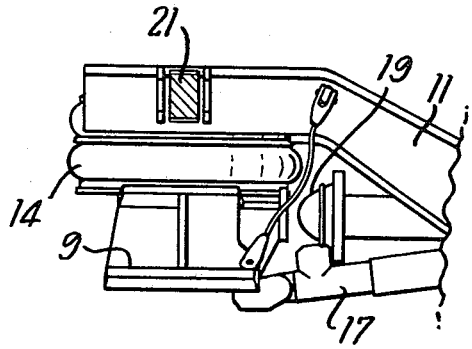
FIG. 3
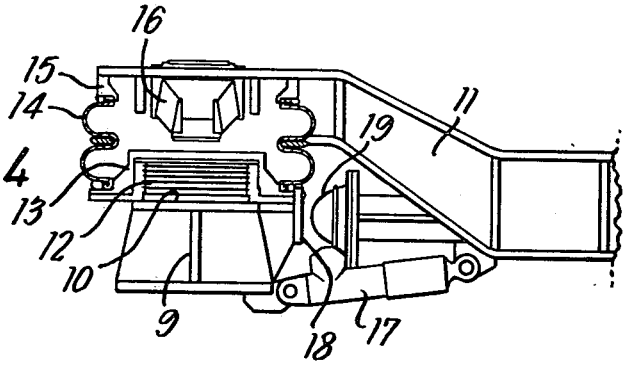
FIG. 4
FIG. 5
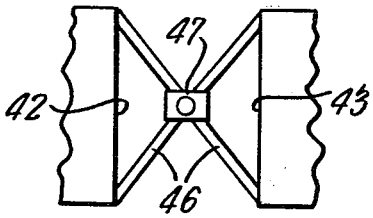
FIG. 6
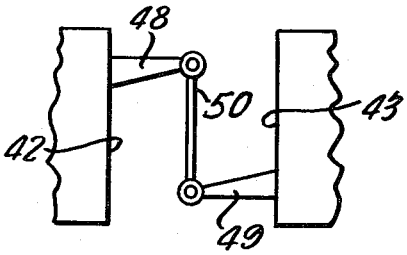

IMPROVEMENTS RELATING TO MOTORIZED RAILWAY VEHICLE TRUCK

This invention relates to railway vehicles and is applicable not only to railway vehicles in which the vehicle body is supported on trucks or bogies, but also where the vehicle body is supported directly on wheel-sets, e.g. four-wheeled vehicles, and where a combination of bogies and wheel-sets may be used to support the body. The invention is also applicable to railway vehicles which are articulated together and where adjacent ends of two vehicles are carried on a single common bogie.

In order to provide for good stabilization of a vehicle at high speed, while permitting relatively free movement of the vehicle through curves in the railway track, an arrangement for a railway vehicle, or bogie therefor, is described and claimed in our U.S. Pat. No. 3,528,374, having at least two wheel-sets each with a live axle mounted in a respective pair of axle bearings, wherein at least one axle bearing of one wheel-set is elastically interconnected with at least one axle bearing of the other wheel-set through bracing means which serve no vertical load carrying function at least intermediate their connections to the axle bearings, said bracing means providing bracing between the wheel-sets which produces high restoring forces when the wheel-sets have a parallel but misaligned disposition, and low restoring forces when the wheel-sets have an aligned but non-parallel disposition.

An advantageous construction of such an arrangement, which provides further improvements particularly in stability, is described and claimed in our co-pending U.S. application Ser. No. 41,169 filed May 21, 1979, now U.S. Pat. No. 4,322,201. Thus, in one aspect of the invention claimed therein, the bracing means comprise a frame structure for each wheel-set which extends transversely of the vehicle and is rigidly connected between axle boxes housing said axle bearings of its respective wheel-set, said frame structures being shaped and arranged so as to be connected together by said elastic connection at a level which is below the axle height of the vehicle; preferably said elastic connection is at such a low level that a bolster can be accommodated within the space so provided between the wheel sets.

With such an arrangement and construction, it is desirable for good curving that the wheel treads have a high effective conicity.

An object of the present invention is to provide an alternative advantageous construction of the basic arrangement described and claimed in our U.S. Pat. No. 3,528,374, particularly for vehicles or bogies of the kind in which each live axle is driven by a motor which is mounted via bearings on said live axle and drives the latter through gearing.

According to this invention there is provided an arrangement for a railway vehicle or bogie therefor, having at least two wheel-sets each with a live axle mounted in a respective pair of axle bearings, and bracing means elastically interconnecting one axle bearing of one wheel set with at least one axle-bearing of the other wheel-set, wherein a traction motor is provided for each wheel-set and comprises a motor casing which is rotatably mounted on its respective live axle via axle bearings, each motor casing is secured against rotation to a fixed part of the vehicle body or bogie, and said bracing means is connected via the motor casings, thereby effectively to provide said elastic interconnection.

In one preferred form, the motor casings provide a pair of opposed walls, and the bracing means includes a pivoted link arrangement which is pivotally connected about at least one vertical axis, between said walls, and arranged so that the motor casings, and hence their respective wheel-sets, are restrained from relative linear displacements, but are free to move relatively to each other with rotational displacements.

In one preferred construction of the pivoted link arrangement, a rod or bar member extends diagonally between two brackets, each pivotally connected to a respective wall of the casing and passes between a pair of spaced bar or rod members which extend diagonally between a further pair of brackets pivotally connected to respective walls, the crossing point of the bar or rod members being co-incident with the central vertical axis between the wheel sets.

In order that the present invention may be readily understood and further features made apparent, a railway bogie and two modifications thereof, constructed in accordance therewith, will now be described, by way of example, with reference to the accompanying drawings in which:

FIG. 3 is a part sectional view on the line III—III of FIG. 1,

FIG. 4 is a sectional view on the line IV—IV of FIG. 1, and

FIGS. 5 and 6 are diagrammatic views of two modified forms of cross-bracing arrangement.

Figure 1:
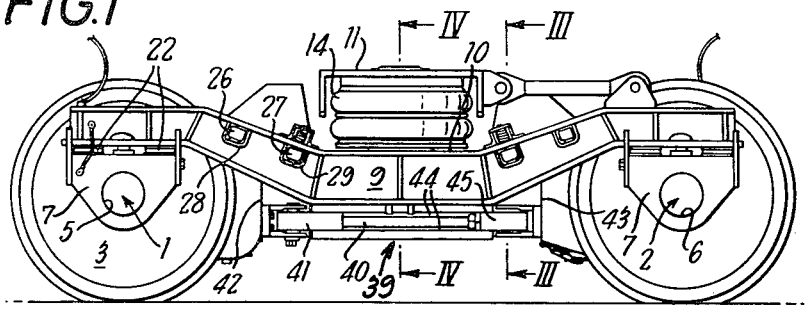
FIG. 1 is a side-view of the bogie.

Referring to FIGS. 1 to 4, the bogie comprises two wheel-sets 1, 2 each comprising wheels 3 mounted on live axles 4, (i.e. each axle is solidly connected to its wheels 3). The wheels shown in FIGS. 1 and 2 have high effective conicity, i.e. in the range 0.05 to 0.5 and preferably 0.2 to 0.3. The wheel-set 1 rotates in axle bearings 5, while the wheel-set 2 rotates in axle bearings 6. The axle bearings are located in this example, but not necessarily, at the two ends of the axles of their respective wheel-sets and each bearing location comprises an axle box 7, which as described and claimed in our said co-pending U.S. Pat. application No. 41,169, can be designed to provide a bearing support surface having an included angle of not more than 180°, so that a cartridge bearing (not shown) can be readily located on said surface and rigidly fixed in position by a suitable part-circular strap.

The axle boxes 7 depend from respective side frames 8 and 9, which in this embodiment are of a fabricated construction somewhat similar to the construction of the side frames described in our co-pending U.S. patent application Ser. No. 41,169. Thus, each side frame is generally of I-section, the dimensions of which vary according to the distribution of load to which it is subjected in use. However, in the present construction no sub-frame is provided, each side frame comprising only a bridge member, the central portion of which is of shallow trough-like form (see particularly FIG. 1) to provide a central horizontal support surface 10.

In this embodiment a bolster 11 is in the form of a cross-beam (which may also be fabricated and of varying I-section) also having a central portion of shallow trough-like form (see FIG. 4). Each end of the bolster is connected to a respective side frame 8 or 9 (see FIG. 4) via a secondary springing arrangement comprising a rubber spring 12 mounted between the side frame support surface 10 and a recessed lower end plate 13 of an air spring 14, the upper end of which is connected via an annular ring 15 to the underside of the bolster end. Each bolster end has a spigot (not shown) which projects through an aperture in the top plate of its respective side frame to co-operate with an annular part 16 constituting a vertical bump stop. Also, to control lateral movement of the bolster with respect to the side frames, a telescopic damper link 17 is provided between each side frame and the bolster (see FIG. 4), each said link having a stop projection 18 for co-operation with a lateral bump stop 19. To complete the connection of the bolster to the side frames 8 and 9, lateral traction links 20 and 21 respectively are pivotally connected between the parts.

It will be appreciated that, if preferred, the bolster need not be provided. Instead, the vehicle body could be mounted directly onto the side frames 8 and 9 via the air springs 14, in which case the bump stop 16 and projection 18 would be arranged to co-operate with parts suitably fixed and arranged on said vehicle body.

In a similar manner to that described in our said co-pending U.S. patent application Ser. No. 41,169, each axle box 7 is flexibly connected to the respective end of its respective side frame 8 or 9, via a primary spring mounting comprising rubber pads 22. These rubber pads act to restrain their respective axle boxes in pitch, but have a relatively low lateral stiffness, i.e. they allow the axle boxes freedom of movement in a horizontal plane. Again, as discussed in our said co-pending patent application, the rubber pads 22 may be in the form of laminated units which are arranged in a horizontal plane (as shown) or inclined to produce a preferred longitudinal/lateral stiffness ratio. Also, the rubber pads 22 in the present embodiment are mounted at a relatively small distance above the axes of the wheel sets 1 and 2 and, consequently, have the advantage referred to in said co-pending patent application, of a relatively low line of action on the bogie for lateral and longitudinal movements.

As known per se, the bogie brakes (not shown) are mounted on a brake beam 23 for the wheel set 1 and a brake beam 24 for the wheel set 2. The beams extend transversely between the side frames 8 and 9 parallel to and at a required spacing from the live axles of their respective wheel sets. The end of each beam is non-rotatably mounted on its respective side frame via a bracket 25, which carries a pair of spaced spigots 26, 27 which fit into respective apertures 28, 29 provided on the side frame. Also, in a manner known per se, traction motors 30, and 31 for the wheels sets 1 and 2 respectively, are mounted directly on their respective live axles 4, each via a pair of spaced axle bearings 32 and 33. The spaced bearings are arranged at each end of a tubular support shaft 34, 35 to which the casings 36, 37 of the respective motors 30 and 31 are securely fixed. To ensure that the motors cannot rotate around their respective live axles 4, each motor casing has a projecting flange 38 which is held fast against the respective brake beam 23 or 24, for example, by being sandwiched between a pair of rubber pads (not shown) which, in turn, are pressed against the underside of the brake beam via a suitable bracket (not shown).

Figure 2:
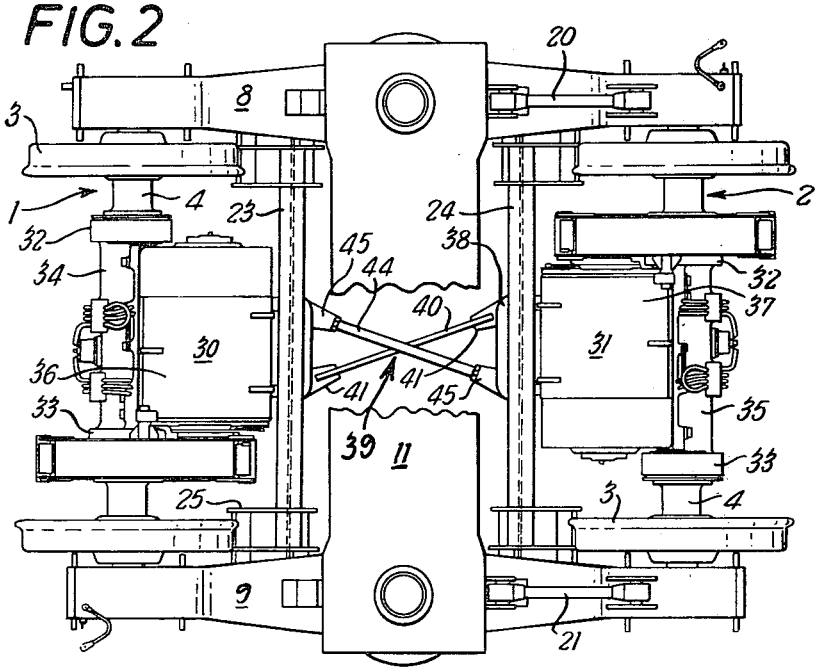
FIG. 2 is a plan view of the bogie.

In accordance with the present invention the motor casings 36 and 37 form part of said bracing means, which further comprises a pivoted link arrangement 39 extending between the motor casings 36 and 37. Referring to FIGS. 1 and 2, in one form the link arrangement comprises an elongate rigid bar or rod member 40 which extends diagonally between two end fittings 41, each pivoted about a vertical axis to its respective adjacent face 42 or 43 (see FIG. 1) of said motor casings. The rod 40 passes between a pair of spaced elongate bar or rod members 44 which extend diagonally and are connected to pivot about a vertical axis to the wall faces 42 and 43 via end fittings 45. In an unstressed, inoperative state of the bogie, the crossing point of the bar or rod members 40 and 45 is coincident with the central vertical axis between the wheel-sets of the bogie.

In an alternative construction shown in FIG. 5, the link arrangement for the bracing means may be similar to the shallow, "V"-frame construction described in our said co-pending patent application, in that the two "V"-frames 46 are flexibly connected at their apices by a suitable friction or resilient pivot connection 47 which restrains the wheel-sets 1 and 2 from relative linear displacement, but allows freedom for relative rotational movement of said wheel-sets (i.e. in the yaw sense). However, instead of the "V"-frames of the link arrangement being connected to respective axle boxes, said frames 46 are rigidly fixed between the opposed faces 42 and 43 of said motor casings.

In a further alternative construction shown in FIG. 6, the link arrangement may comprise a bracket 48, 49 projecting from each of the opposed faces 42, 43 of said motor casings so as to be laterally spaced from each other, and a laterally extending bar or rod member 50 which is pivotally connected at each end, about a vertical axis, to a respective bracket, via rubber or like bushings to provide a frictional restraint for the pivoting movement. However, this construction is only suitable for use where the brake system allows. Thus, it would not be suitable for a "pusher" brake system, where the brake pads are pushed or forced into engagement with their respective wheels. This is because the link arrangement will permit relative longitudinal movement between the motor casings and hence said casings cannot take up the reaction of the forces.

The arrangement of the opposed wall faces 42 and 43 and the pivoted link 39 is such that the latter can be located at any convenient height. However, in order to achieve at least the advantage of mounting the primary springing (i.e. the rubber pads 22) a relatively small height above the live axles 4 of the wheel sets 1 and 2 described in our said co-pending U.S. application Ser. No. 41,169, as shown in FIG. 1 the pivoted link is connected substantially below the level of said live axles.

It will be appreciated from the foregoing that, by connecting the pivoted link arrangement 39 directly to the motor casings, the bracing means effectively flexibly interconnects the axle bearings 32, 33 of the motor casings, and thereby the axle bearings 5, 6 of the wheel-sets 1 and 2.

The preferred embodiment or bogie described above is particularly suitable for a rapid transit system in which all or most of the live axles 4 are to be motored by a relatively small traction motor mounted thereon.

We claim:

1. A railway vehicle truck comprising:

a pair of side frames;

at least two wheel sets each having a live axle mounted in a respective pair of axle bearings;

a traction motor for each wheel set comprising a motor casing mounted for rotation on said associated live axle via a mounting means which otherwise maintains the motor casing rigid with and substantially parallel to said associated live axle;

means for securing each motor casing to prevent rotation of said motor casing about its said associated live axle;

and bracing means comprising at least one link member connected between said motor casings on the respective wheel sets and being pivotably resiliently mounted for rotation about at least one vertical axis positioned directly between said casings, said bracing means providing a stiffness through said motor casings to restrain parallel shear movement of one of said wheel sets relative to the other in a substantially horizontal plane.

2. A railway vehicle truck according to claim 1, wherein said bracing means comprises an elongate first member extending diagonally between and pivotally connected to respective wall faces of said motor casings and passing between a pair of spaced elongate second members which extend diagonally between and are pivotally connected to respective further wall faces of said motor casings, the crossing point of said first and second elongate members being coincident with the central vertical axis between the wheel sets.

3. A railway vehicle truck according to claim 1, wherein said bracing means comprises a pair of elongate members diagonally disposed relative to each other and connected to respective wall faces of the motor casings and connected together at their apices by resilient pivot means, said apices being coincident with the central vertical axis between the wheel sets.

4. A railway vehicle truck according to claim 1, wherein said bracing means comprises a pair of brackets projecting respectively from the wall faces of the motor casings for the respective wheel sets so as to be laterally spaced from each other one on each side of the central vertical axis between the wheel sets, and an elongate member which is pivotally connected at each of its ends to a respective bracket by a resilient pivot means.

* * * * *